United States Patent [19]

Favaro

[11] Patent Number: 4,573,573

[45] Date of Patent: Mar. 4, 1986

[54] PROTECTIVE COVERING FOR PORTABLE AUDIO DEVICES

[76] Inventor: Lori Favaro, 56 Briarcliffe La., Bourbonnais, Ill. 60914

[21] Appl. No.: 688,180

[22] Filed: Jan. 2, 1985

[51] Int. Cl.[4] ..... A45C 11/00; B65D 65/06

[52] U.S. Cl. ..... 206/305; 206/216; 150/52 R

[58] Field of Search ..... 206/305, 216; 150/52 R, 150/52 J; 455/351

[56] References Cited

U.S. PATENT DOCUMENTS

| | | | |
|---|---|---|---|
| 2,504,252 | 4/1950 | Corey | 150/52 R |
| 3,081,807 | 3/1963 | Lightburn | 150/52 R |
| 3,824,472 | 7/1974 | Engel et al. | 455/351 |
| 4,000,769 | 7/1977 | Katz | 206/316 |
| 4,347,956 | 9/1982 | Berger | 150/52 R |

FOREIGN PATENT DOCUMENTS

| | | | |
|---|---|---|---|
| 21715 | of 1897 | United Kingdom | 150/52 R |

*Primary Examiner*—George E. Lowrance
*Assistant Examiner*—Brenda J. Ehrhardt
*Attorney, Agent, or Firm*—Laff, Whitesel, Conte & Saret

[57] ABSTRACT

A novel cover for a portable personal audio unit is disclosed. The cover is produced of a unitary flexible piece which is folded around an audio unit. Flexible construction and non-specifically located hook and loop type fasteners allow the cover to be adapted to fit a variety of units. Releasable flaps completely enclose the audio unit or leave its controls accessible as desired.

11 Claims, 7 Drawing Figures

PROTECTIVE COVERING FOR PORTABLE AUDIO DEVICES

BACKGROUND

1. Field the Invention

The present invention relates generally to a case for a personal portable audio cassette player or radio unit. More particularly, the present invention relates to a decorative and protective cover for enhancing the environment of the personal cassette player or radio unit such that mechanical and electrical reliability of the audio equipment is enhanced and preserved.

2. Brief Description of the Background Art

In recent years, the proliferation of personal stereo cassette players and radios has been explosive. The use of these devices, which provide for either tape or radio audio reproduction, has been prompted by a desire for musical accompaniment during jogging, bicycling, skiing or aerobics, when carrying a larger portable audio unit would be inconvenient, while commuting on public transportation, when listening to a larger portable audio unit would be illegal, or while at the beach, when a larger portable audio unit could not be properly stored and would most likely be stolen.

These uses, for which personal audio units were specifically intended, bring these audio units into environments hostile to their longevity. At the beach, extreme heat and sunlight attacks and warps plastic parts, and sand particulates tend to abrade and jam high-tolerence micro-fitted cassette drive mechanisms. Cold conditions, as encountered when skiing or skating, inhibit battery performance, gel lubricants and make delicate plastic pieces and cassette tape media brittle. Moisture is imparted during various forms of exercise due to both inclement weather and perspiration, the latter of which particularly encourages both rust and control jamming of audio units because of dissolved salts. Additionally, personal audio units are suceptible to shock impact during virtually any activity due to their extraordinary portable nature.

Heretofore available prior art protective devices for audio units have not taken these adversities into account. Analogous art carrying devices have been disclosed in U.S. Pat. No. 3,081,807 to Lightburn; U.S. Pat. No. 3,813,017 to Pimsleur; U.S. Pat. No. 4,347,956 to Berger and U.S. Pat. No. 4,420,078 to Belt, et al.

Lightburn relates to a foldable carrying case for a radio with openings for controls, but the case provides for no impact-distributing material, does not utilize moisture-proof materials and is only intended to accomodate one particular radio.

Pimsleur and Belt each disclose conventional enclosures, neither of which provide the combination of benefits yielded by the present invention.

Berger teaches a holder and harness assembly for an auditory training device of a specific size which is designed to be worn against the chest of the user.

SUMMARY OF THE INVENTION

It is an object of the present invention to provide a temperature-insulating protective covering for a personal audio unit.

It is another object of the present invention to provide a protective holder which is capable of accomodating personal audio units of various sizes.

It is an object of the present invention to provide a holder for a personal audio unit that permits ready accessiblity to controls for the audio unit, as well as means to cover the controls after all proper settings of the audio unit have been established.

It is a further object of the present invention to provide an impact-resistant holder for a personal audio unit.

It is yet another object of the present invention to provide a dust and moisture-resistant personal audio unit holder.

It is another object of the present invention to provide a personal audio unit holder that floats upon immersion in water.

In a broad embodiment of the present invention, these objects and others are provided by a novel personal audio unit protective cover and holder. This audio unit holder comprises a flexible sheet having adjustable flaps and provided with hook and loop type closure devices to provide a selectively accessible envelope for the audio unit.

DETAILED DESCRIPTION OF THE INVENTION

Figure 1:
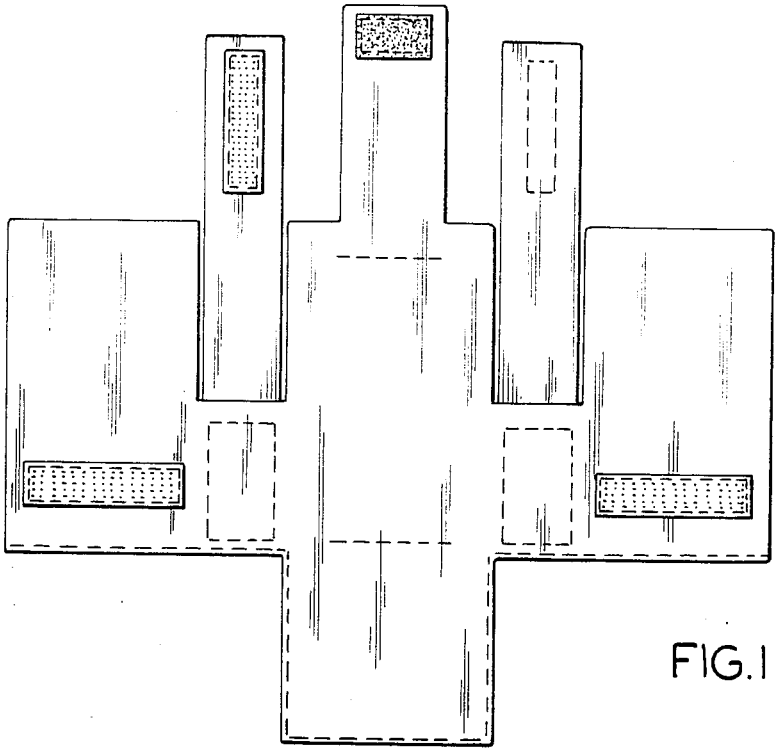
FIG. 1 is a plan view of one side of an unfolded embodiment of the audio unit holder comprising the present invention.
Figure 2:
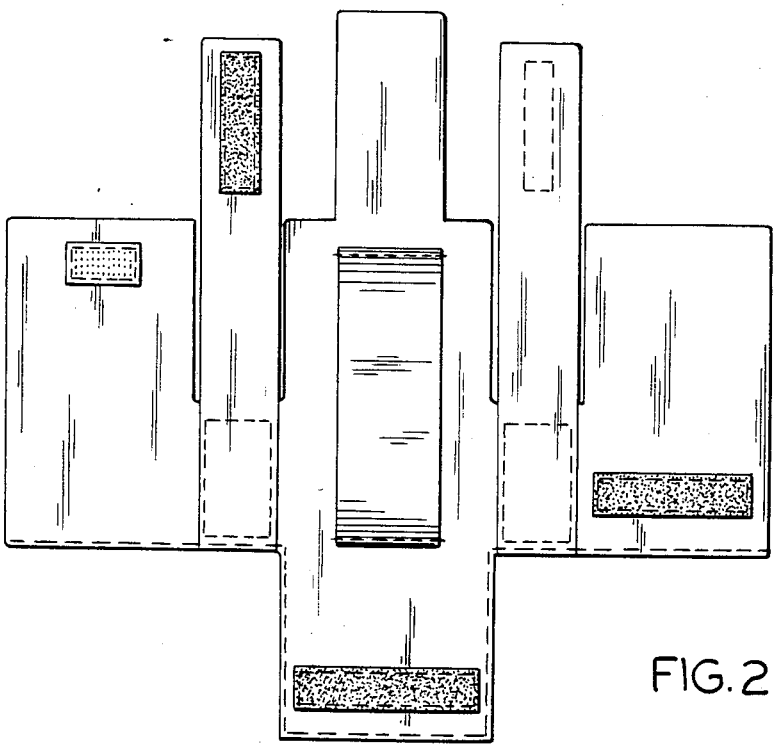
FIG. 2 is a plan view of the reverse side of the invention shown in FIG. 1.
Figure 3:
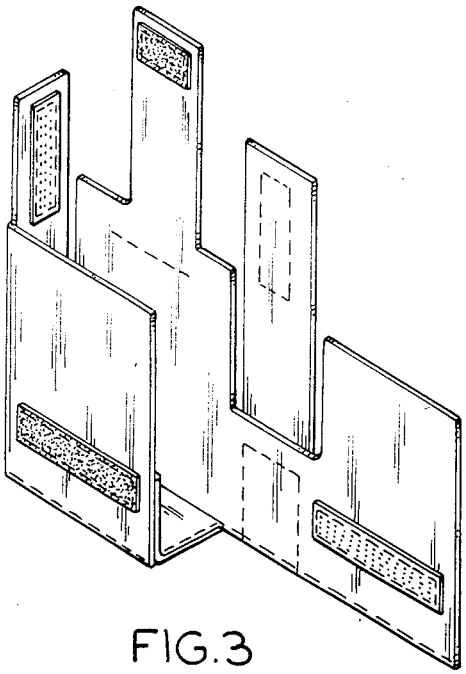
FIG. 3. is a partially cut away perspective view of the present invention in an initial state of assembly.
Figure 5:
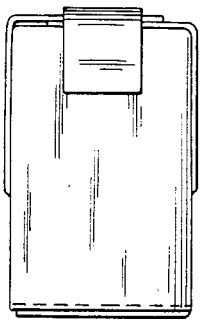
FIG. 5 is a front view of the present invention fully assembled.
Figure 7:
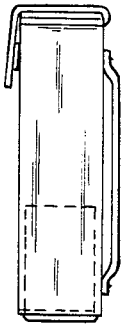
FIG. 7 is a side view of the invention shown in FIG. 5.
Figure 6:
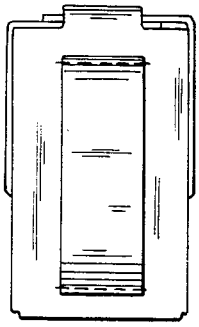
FIG. 6 is a rear view of the invention shown in FIG. 5.

Referring to FIGS. 1 and 2, the present invention, generally designated by the numeral 10 is designed to conveniently contain and protect a variety of personal portable audio units (not shown) of the type which are in common use today. Usually, these audio units comprise controls along one or more of the sides of the unit. Device 10 includes flexible inner skin material 12 and outer skin material 14 containing any suitable shock-absorbing, impact-dispersing floatation material 16 (FIG. 3). Material 16 can be made of fabrics, plastic or the like. Edges of device 10 where inner skin 12 and outer skin 14 abut may be seamed by any appropriate method, including but not limited to heat welding, sonic soldering, gluing or conventional stitching. At least one of inner and outer skins 12, 14 is selected of a water-resistant or water-proof material, and outer skin 14 is preferentially a high-visibilty luminescent or reflective color for enhanced daytime and evening conspicuity.

Device 10 includes a rectangular back panel section 18, the lower end of which includes a substantially square panel section 20, which functions in part as the bottom panel 22 of device 10. Left and right front panels 24, 26 are provided which attach to back 18 by left and right lower side panels 28, 30, respectively. Attached to the upper edges 32, 34 of left and right lower side panels 28, 30 are left and right upper side panels, or flaps, 36, 38, respectively. Each of left and right upper side panels or flaps 36, 38, contains a top section extending above the upper edge of back 18. An elongated closure tab 40 is provided at the top of back 18 to secure the individual sections and panels in an assembled configuration, as will be explained hereinbelow.

To assemble the present invention, a portable audio unit is placed against back 18 (FIG. 1). Square section 20 is then bent, first around the bottom rearward edge of the audio unit, and then around the bottom forward edge of the unit. It is seen that a first part of a hook and loop type fastener 42 (FIG. 2) is attached to the surface of square 20 now facing forward. Although other fastening devices with similar functions may be used, hook and loop type fasteners allow a large degree of adjustability in the fit of the device 10, and are conveniently releaseable without tools or fuss while providing secure adhesion for whichever panels are so secured. Left lower section 28 is then folded around the left rearward edge of the audio unit and then left front section 24 is folded around the left forward edge of the unit. The inner surface of left front section 24 is provided with a complimentary part of a hook and loop type fastener 44 (FIG. 1), and left front section 24 is then attached to square panel 20. It is seen that a first part of a hook and loop type fastener 46 is attached to the now forward-facing surface of left front section 24. This is the stage of the assembly as seen in FIG. 3.

Right lower section 30 is then folded around the right rearward edge of the audio unit and then right front section 26 is folded around the right forward edge of the unit. The inner surface of right front section 26 is provided with a complimentary part of a hook and loop type fastener 48, and right front section 26 is then attached to left front section 24.

Figure 4:
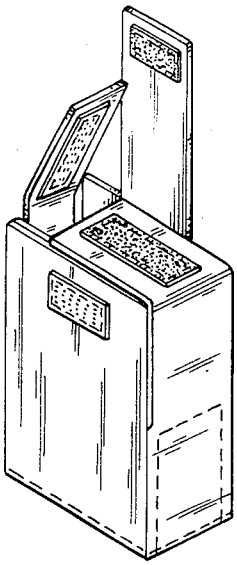
FIG. 4 is a perspective view of the present invention in an intermediate state of assembly.

At this point, right upper side panel 38 is folded over the right top edge of the audio unit (FIG. 4). It is seen that a first part of a hook and loop type fastener 50 is attached to the now upwardly-facing surface of right upper side panel 38. Left upper side panel 36 is then folded around the left top edge of the audio unit. The inner suface of left upper side panel 36 is provided with a complimentary part of a hook and loop type fastener 52, and left upper side panel 36 is then attached to right upper side panel 38. Finally, closure tab 40 is brought forward around the top rear and top front edges of the audio unit, and secured to right front panel 26 by both a first part and a complimentary part of a hook and loop type fastener 54, 56, located on the outer surface of right front panel 26 and adjacent the end of closure tab 40, respectively, each part facing the other.

It is now seen how a device providing the various benefits and objects from the summary of this invention has been provided. Audio units of varying lengths may be accomodated by appropriate adjustment of square panel 20, while extremely long units may be accomodated by appropriate adjustments both at the bottom of device 10 by square panel 20, and at the top of device 10 by the left and right upper side panels 36, 38. Similarly, required adjustments for depth and width are made simultaneously be reclosing the left and right front panels 24, 26. The widths of each mating pair of hook and loop type fasteners is sufficient to allow fastening and closure of the corresponding parts at varying positions of the corresponding panels. In this manner, most personal audio units may be contained snugly so as to preclude accidental displacement and yet loosely enough to afford a measure of shock dissipation upon impact. The multi-layer protective holder thus formed protects the audio unit from temperature variations and direct sunlight. The buoyancy imparted to the unit by the cover allows many such units to float upon accidental immersion in water, and the precision fit of the cover around the audio unit protects the unit from dust, sand and moisture. It is seen that conventional earphones or headphones can be plugged into the audio unit while the holder is closed by threading their connecting wires between appropriate holder panels. Additionally, by leaving one of left or right upper side panels 36, 38 unattached, any controls located on the top, and upper left or right, respectively, of the unit may be left accessible to the user. Any such unattached panel may be left free, or folded underneath the appropriate lower side panel 28, 30. For additional user convenience, loop 60 is provided on the outside of back 18. Loop 60 may be used as a handle, or threaded through a user's belt or suspenders, or if elaticized, may be slipped over a user's arm.

It should be understood that various modifications can be made to the preferred embodiments disclosed herein without departing from the spirit and scope of the invention or without the loss of its attendant advantages. Thus, other examples applying the principles decribed herein are intended to fall within the scope of the invention provided the features stated in any of the following claims or the equivilant of such be employed.

I claim:

1. A one-piece flexible cover for a personal audio unit, said cover comprising adjustably dimensioned panels having an inner and an outer layer of material with one layer of shock-absorbing material located thereinbetween, said adjustable panels including: a rectangular back panel, lower left and lower right side panels flexibly attached to opposite sides thereof, rectangular front panels flexibly attached to each of said lower left and lower right side panels, elongated edge panels attached to each of said lower left and lower right side panels and an elongated closure member attached to the top of said back panel whereby the flexible cover allows for flexible attachment hinges which may be located as best required to fit said audio unit, the cover further including:

first fastening means on said back panel which releasably attach said back panel to one of said front panels;

second fastening means on said front panels which releasably attach each said front panel to each other;

third fastening means on said edge panels which releasably attach each said edge panel to each other; and fourth fastening means on said closure member and on one of said front panels which releasably attach said closure member and such front panel to each other wherein each said fastening means provides dimensional variability in that a plurality of sizes of audio units may be effectively contained by said cover.

2. The one-piece flexible cover for a personal audio unit of claim 1, wherein said shock-absorbing material further comprisies a floatation device.

3. The one-piece flexible cover for a personal audio unit of claim 1, wherein at least one layer of said material is water-resistant.

4. The one-piece flexible cover for a personal audio unit of claim 1, wherein said outer layer of material is highly reflective.

5. The one-piece flexible cover for a personal audio unit of claim 1, wherein said outer layer of material is luminescent.

6. The one-piece flexible cover for a personal audio unit of claim 1, wherein said cover further includes carrying means.

7. The one-piece flexible cover for a personal audio unit of claim 6, said carrying means comprising a closed loop attached to said back panel.

8. The one-piece flexible cover for a personal audio unit of claim 1, wherein each said fastening means comprise hook and loop fasteners.

9. The one-piece flexible cover for a personal audio unit of claim 1, wherein said audio unit includes control means, wherein each said edge panels fastening means are selectively attachable and disengagable to permit access to said controls when desired.

10. The one-piece flexible cover for a personal audio unit of claim 1, wherein said audio unit includes audiophones functionally attached to said unit by connecting wires, wherein said audiophones can be so attached to said unit by threading said wires between said panels.

11. The one-piece flexible cover for a personal audio unit of claim 1, wherein each said fastening means comprise hook and loop fasteners.

* * * * *